United States Patent [19]

Sacchetti

[11] 4,036,157

[45] July 19, 1977

[54] AUTOMATIC THREAD CHANGER

[76] Inventor: Alfred D. Sacchetti, 1903 Sharon Road, Meadowbrook, Pa. 19046

[21] Appl. No.: 639,569

[22] Filed: Dec. 10, 1975

[51] Int. Cl.[2] ..... D05B 1/08

[52] U.S. Cl. ..... 112/163

[58] Field of Search ..... 112/163, 167, 79 R, 112/79 A

[56] References Cited

U.S. PATENT DOCUMENTS

| | | | |
|---|---|---|---|
| 2,556,068 | 6/1951 | Crawford | 112/79 R |
| 2,832,301 | 4/1958 | Wear | 112/79 R |
| 3,247,814 | 4/1966 | Polevitzky | 112/79 A |
| 3,641,955 | 2/1972 | Brown et al. | 112/79 R |

*Primary Examiner*—Werner H. Schroeder
*Assistant Examiner*—Peter Nerbun
*Attorney, Agent, or Firm*—Caesar, Rivise, Bernstein & Cohen, Ltd.

[57] ABSTRACT

An automatic thread changer including means to move a plurality of threaded needles, one by one, into operative connection with a needle bar assembly. The threaded needles are each secured to a particular needle holder that will be urged into operative connection with the needle bar assembly by the action of a pivotal block in accordance with movement of a travelling carriage. Each needle holder carries a different color thread, such that the color of the thread is automatically changed by appropriate travel of the carriage to position the particular needle holder into operative connection with the needle bar assembly. A cam is provided to cause the needle holder and its pivotal block to rotate the needles not being used to a position that is clear of the operator while the needle holder that is being used will be pivoted downwardly under the action of the cam, such that the particular needle holder will temporarily become part of the needle bar assembly. A thread release and guide is also provided which will exert a tight clamping action on each thread to hold the thread immobile while the carriage is moving and then release the thread when the movement of the carriage ceases. In the preferred embodiment of the invention, the carriage travels back and forth under the driving force of a stepping motor as actuated by a switch or series of switches.

10 Claims, 7 Drawing Figures

AUTOMATIC THREAD CHANGER

This invention relates to an automatic thread changer and has as its objective the provision of an automatic thread changer to replace the tedious method of changing from one thread color to another thread color on a sewing machine.

It is the present practice in changing thread color to remove a spool and rethread the machine before it is possible to sew with a different color thread. Such practice is tedious and time consuming and also causes operator fatigue.

It is accordingly an object of the invention to provide an automatic thread changer which eliminates the tedious steps connected with changing of thread in a sewing machine.

It is a further object of the present invention to provide an automatic thread changer which can effect the introduction of a needle having a different color of thread associated therewith in a small fraction of time necessary to change thread on an existing needle;

Yet another object of the present invention is to provide an automatic thread changer which can be marketed at a reasonably low cost and which will accomplish substantial time savings in essentially eliminating the time necessary for rethreading.

The foregoing, as well as other objects of the invention are provided by the automatic thread changer of the present invention wherein the travelling carriage advances a desired needle holder into operative connection with the needle bar assembly. In the specific embodiment disclosed herein, the automatic thread changer will carry four needle holders, thereby enabling a single machine to sew these four different color threads, although it is clear that a larger or smaller number of needle holders can be employed. The present invention further includes a movable carriage operated by a stepping motor such that a particular needle holder can be advanced into operative connection with the needle bar assembly by switching means.

Other objects of the invention will become more readily apparent by reference to the accompanying drawings wherein.

Figure 1:
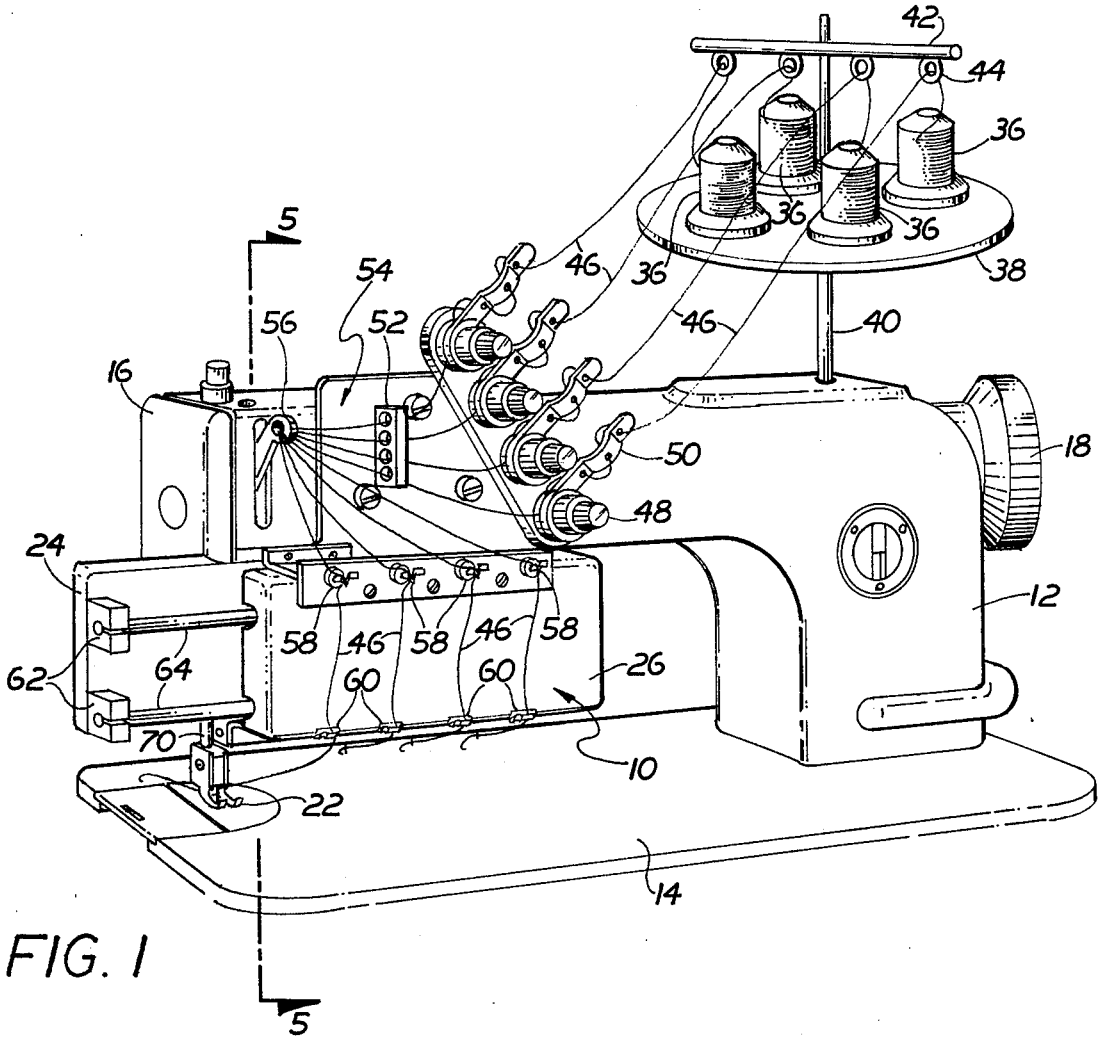
FIG. 1 is a three-dimensional view showing a specific embodiment of the automatic thread changer of this invention mounted into operative connection with a sewing machine.

Referring now to the various figures of the drawings wherein like reference characters refer to like parts, there is shown at 10 in FIG. 1 an automatic thread changer embodying the present invention and secured to a conventional sewing machine 12, the details of construction of which are well-known to those skilled in the art.

The sewing machine 12 is of constructional convention and includes base 14, sewing machine head 16, sewing machine wheel 18, needle bar assembly 20 and presser foot 22.

It will be seen that the automatic thread changer basically comprises mounting plate 24 (FIG. 3) which receives carriage 26 for sliding movement thereon as will be discussed hereinafter.

The conventional sewing machine 12 requires only slight modification in order to receive the automatic thread changer of the present invention. This is done by removing the tensioner 120 (not shown), putting a notch and a detent in the needle bar assembly and drilling and tapping holes 30 (FIG. 3).

Figure 3:
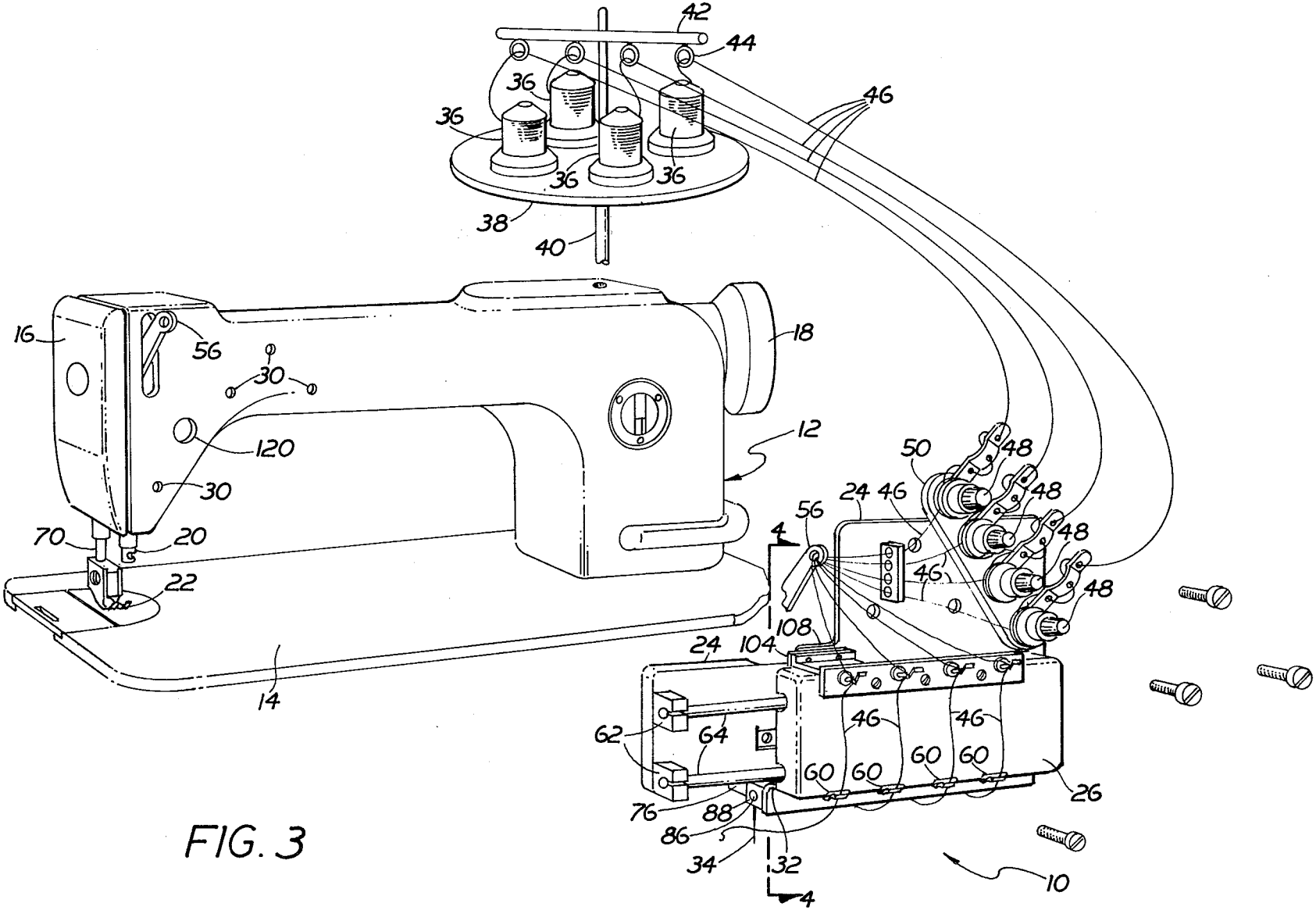
FIG. 3 is an exploded three-dimensional view of the automatic thread changer of FIG. 1.
Figure 6:
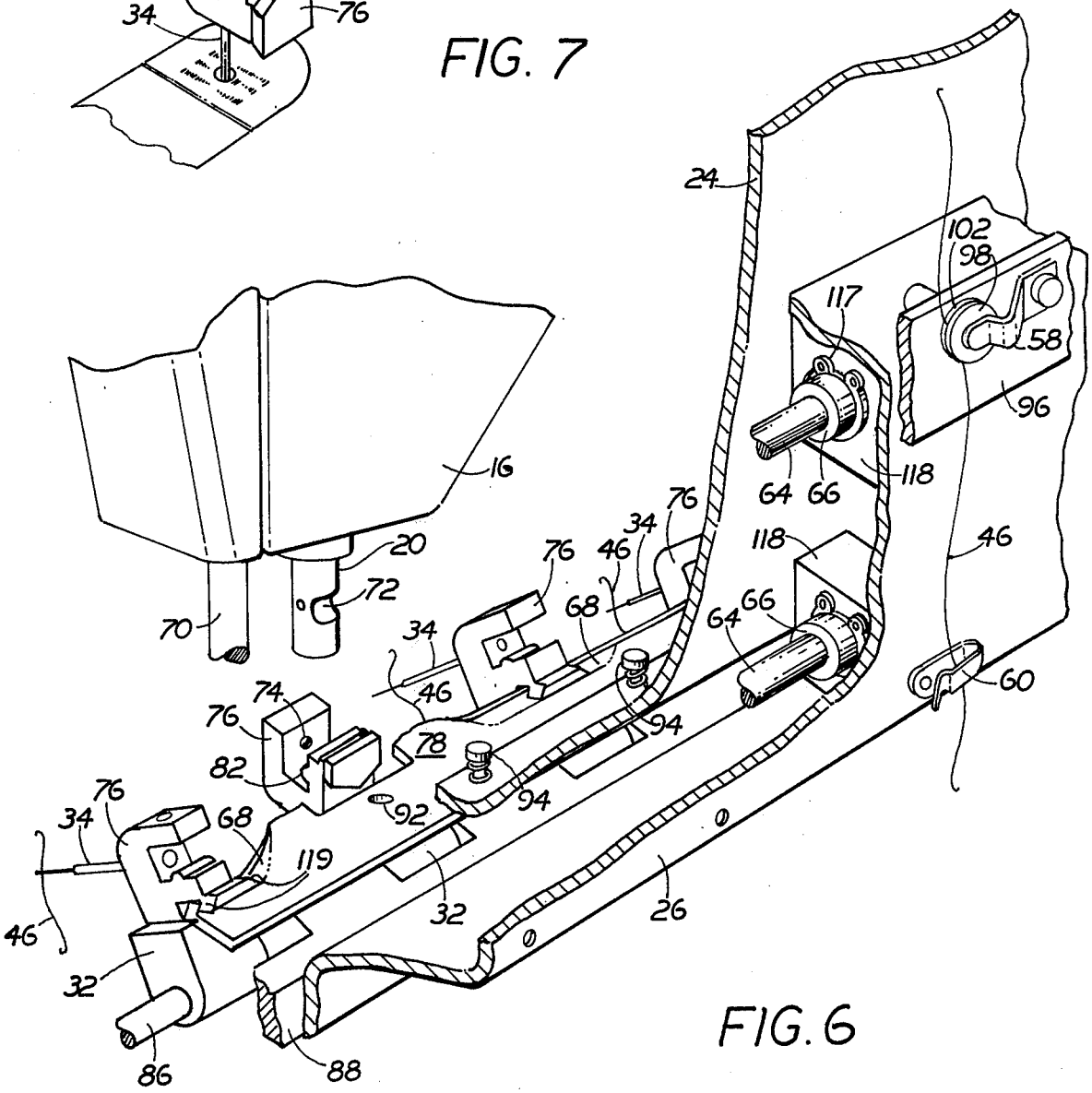
FIG. 6 is a fragmentary, enlarged, three-dimensional view taken from the opposite side of the sewing machine as compared with the direction of FIG. 1.

The details of the automatic thread changer 10 are best seen by making an initial review of FIGS. 3 and 6. The automatic changer 10 operates on the principle of providing a plurality of pivotal blocks, each of which carries a sewing needle 34, which the carriage 26 advancing a desired needle holder 76 into operative connection with the needle bar assembly. The sewing machine mechanism then operates that particular needle which has been advanced into operative connection therewith.

Each needle holder carries a different color thread, such that the color of the thread is automatically changed by appropriate travel of the carriage 26 to position a particular needle holder 76 into operative connection with the needle bar assembly. The action of carriage 26 will automatically snap out the particular needle holder 76 from the needle bar assembly 20, thereby allowing the next desired needle holder 76 to be advanced into operative connection with the needle bar assembly 20 by the travelling carriage 26.

Figure 7:
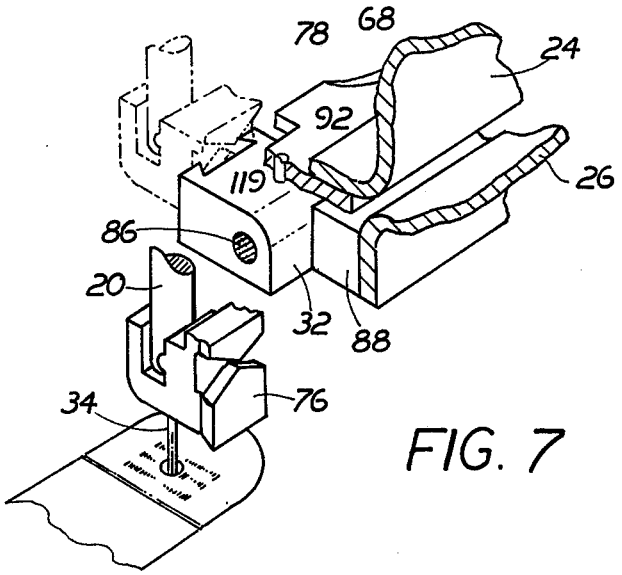
FIG. 7 is a fragmentary, enlarged, three-dimensional view, showing the relationship of a needle holder, pivot block, and needle bar assembly.

Each needle holder 76 is carried in a pivot block 32 by means of a dovetail slot 119 (FIG. 7). When the needle holder 76 is locked to needle bar assembly 20, it will be free to slide up and down in dovetail slot 119 of pivot block 32 which is now in a stationary position. Pivot blocks 32 are pinned to trunion block 88 which is fastened securely to carriage 26.

Reference is now made to FIG. 3 for further details of the automatic thread changer 10. The various spools of thread of different color 36 are secured in a conventional manner on a stand 38 which extends from the support 40 to which is also secured an arm 42 having eyelet 44 through which the various threads 46 are guided to tensioners 48 that are secured through mounting strip 50 that extends from the mounting plate 24. The thread 46 is then led from the tensioner 48 to a thread leader that is attached to the mounting plate extension 54. The thread is then passed through the thread puller 56 of the sewing machine base 14 and then through the thread release and guide 58 (for each thread) that is attached to the carriage 26 as can be seen in FIG. 3. The thread 46 then passes through guides 60 and then to the sewing needles 34.

Figure 2:
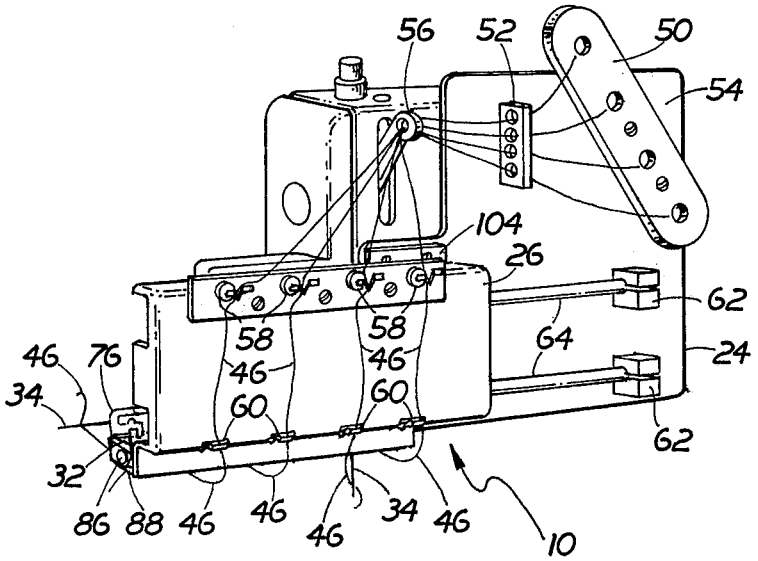
FIG. 2 is a view similar to FIG. 1, but showing only the automatic thread changer invention and with the carriage advanced to a lefthand position.
Figure 5:
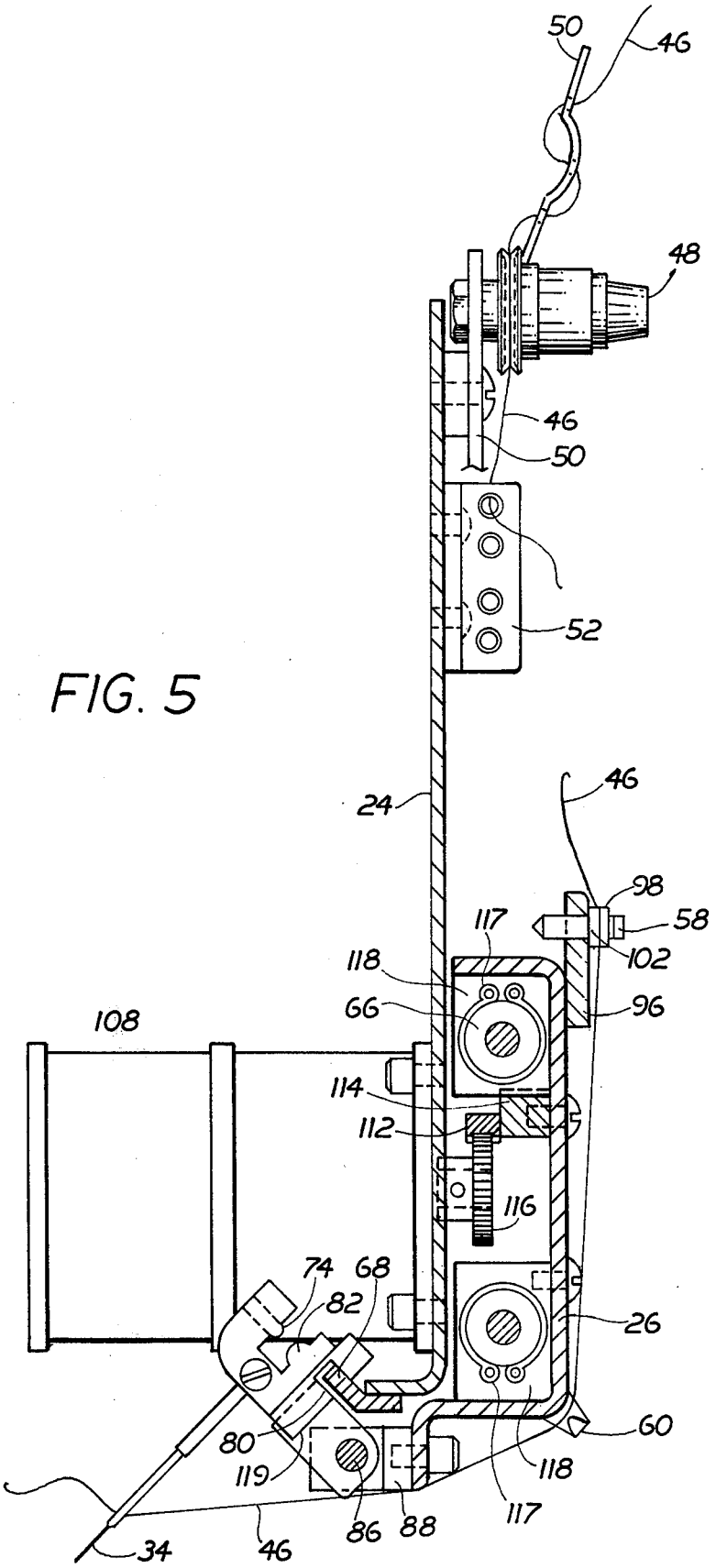
FIG. 5 is a sectional view, similar to FIG. 4, but taken further to the right as viewed in FIG. 1, and showing a needle holder and pivot block in the disengaged position.

FIG. 1, 2 and 3 reveal that the mounting plate 24 carries rail support blocks 62 which receive and hold the stationary guide rails 64 upon which carriage 26 travels in order to position a particular needle holder 76 into operative connection with the needle bar 20. The carriage 26 possesses four ball type bushings 66 (FIG. 5). Bushings are held in place by snap rings 117. Said bushings are fitted into mounting block 118 which in turn are securely fastened to carriage 26. These bushings 66 now enable the carriage 26 to be held on to the rails 64 and to slide or travel thereon as will be discussed hereinafter. Also attached to the carriage 26 is a cam 68 whose function will be described hereinafter.

It will be appreciated that FIG. 2 differs from FIG. 1 in showing that the carriage 26 has traversed from the righthand position of FIG. 1 to the lefthand position of FIG. 2. It will be understood that in the specific embodiment of the invention shown that the carriage can traverse from right to left, or left to right and stop at any one of the intermediate positions. Clearly, the automatic thread changer can be provided with a lesser or greater number of stations, depending upon the number of different colors desired.

Additional details are shown in FIG. 6, including the presser foot shaft 70 and the needle bar 20 which has notch 72 formed therein. Also shown is spring loaded ball 74 in the outer wall of needle holder 76. The ball 74 serves to hold the needle holder 76 in operative position with reference to the needle bar 20 as will be described hereinafter. Other details visible in FIG. 6 are the needle bar cam 68 and the needle holders 76 and the pivotal block 32.

It will be appreciated that the needle bar cam 68 is stationary and is a part of the mounting plate 24. The needle holder cam plate 68 possesses a track and flat area 78 and each of the needle holders 76 possesses a notch 80 such that when the carriage 26 is actuated, the notch 80 is caused to ride on the cam track 68. This action causes the needle holder and pivotal block to rotate the needles not used, clear of the operator. However, the needle holder 76 that is to be used will pivot downward on to the flat area 78 so that the needle 34 lies in a vertical plane as the needle holder 76 is brought into operative connection with the needle bar 72 and projecting ledge 82. When connection is complete, needle holder 76 has now become part of the needle bar assembly 20 (FIG. 7) and is free to slide up and down in dovetail slot 119 of pivotal block 32. Finally, there is also shown in FIG. 6 the thread release and guide 58 as well as one of the thread guides 60 for guidance of thread 46.

Figure 4:
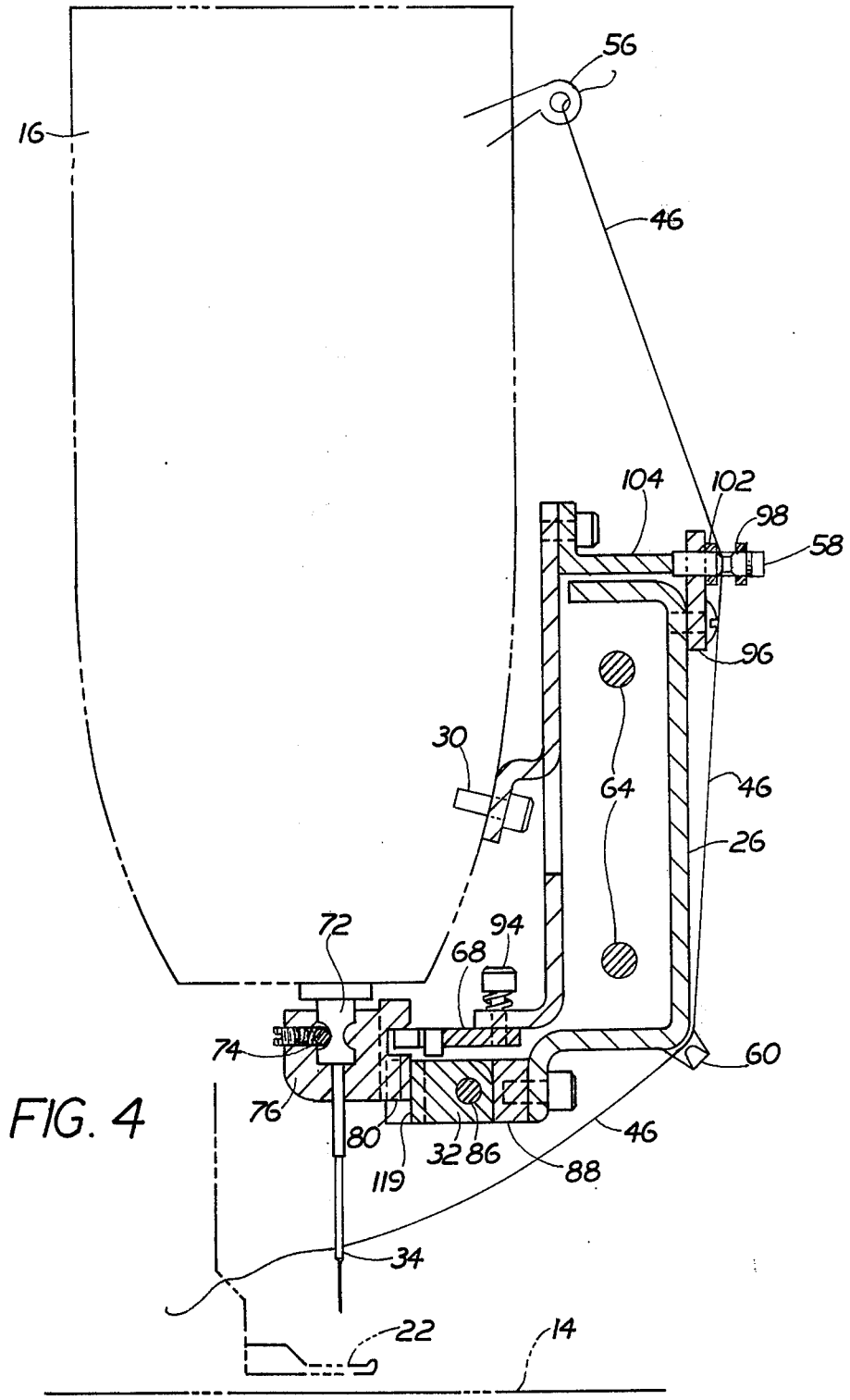
FIG. 4 is a somewhat enlarged, vertical sectional view taken through the automatic thread changer of FIG. 1 to the left of the needle bar assembly and presser foot and looking to the right as viewed in FIG. 1 in order to show certain details of the mounting plate and carriage.

Other operative details of the invention are better understood by reference to FIGS. 4 and 5. Particular attention is called to the needle bar assembly 28 which has a notch 72 therein, (configuration of this notch can vary). Also provided as a part of the needle holder 76 is a detent or spring loaded ball 74 as previously discussed. This enables the positive locking in of a particular needle holder 76.

As further shown in FIG. 4 and 6, the various pivot blocks 32 are pivotally secured on the trunion block 88 by pin 86. Of further interest is the trunion block 88 and fastener 90. This block acts as a guide and stops the pivot block 32 from flopping. The cam 68 can also be seen in FIG. 4 and it should be noted that a stop 92 is provided which acts to prevent further pivoting of a particular pivot block 32 when in an operative position. Attention is directed to spring and screw 94 which gives a floating action to the cam plate 68 for misalignment of the needle bar assembly 20 in the up position.

Certain details of the thread release and guide 58 can also be seen in FIG. 4. In particular there is the guide plate 96 through which pin 98 passes with the pin 98 having a hole 100 to permit passage of thread 46. There is also a rubber washer 102 which helps to hold the thread 46. Upon actuation of the carriage 26, cam 104 (FIG. 4) which is fastened to mounting plate 24 strikes pin 97 as it passes the cam, thereby forcing open the leaf spring 106. At such a time the thread release and guide 58 allows free passage of thread 46 under action of the sewing machine and conversely when pin 98 is not in use, it will pass by cam 104 and slip off and in conjunction with the rubber washer 102 it will provide a tight clamping action upon the thread 46, to hold the thread 46 immobile between clamp and needle while carriage is moving (FIG. 5).

The carriage 26 travels back and forth under the driving force of a conventional bi-directional stepping motor 108. The action of the motor 108 has the effect of driving gear 110 which in turn actuates gear rack 112 which is held by gear rack support 114 attached to carriage 26. This causes movement of the carriage 26 along guide rails 64.

The action of the stepping motor is in accordance with the wiring whereby the carriage can be moved back and forth to any one of four positions upon actuation of a button. There is a printed circuit using a pulsator to drive the bidirectional stepping motor 108 with a 0.75 P.D. drive gear 116 and rack 112. The stepping motor 108 will index 10 degree per impulse or 0.0654 inches. The pitch of the carriage 76 is 1.243 or 19 impulses from pulsator. The stepping motor 108 is rated at 15 impulses per second or 1.22 seconds to move from station to station. Stated another way, the solid state control system involves printed circuitry such that the pulser tells the bi-directional stepping motor 108 how many steps to take. Alternatively, the motor can be eliminated and the carriage 26 slid by hand from position to position.

In conclusion, the automatic changer of this invention moves a plurality of threaded needles to and from a sewing machine needle bar and operatively connects the sewing needle to the needle bar assembly. The thread in the needle can vary in color, material and thickness. Also, the needle sizes can vary accordingly. In this fashion, the tedious method of changing from one color to another; namely, removing the spool, rethreading the machine and needle can be avoided, thus eliminating down time. With this invention, an operator can at a glance see the next color of the garment to be sewn, press the proper button and within 1.22 seconds a new needle and color is presented. In this fashion, the operator does not lose the all important rythym and time required fumbling, looking for the new color spool and rethreading.

The invention can also be used where presently a plurality of sewing machines are used in a line. In this instance, depending on how the machine is driven, (computer, tape, etc.), an interface of the computer's supplied or of set buttons for those not driven by computer. In every event, the system is the same; that is when a signal is received that a new color is required, a button is pressed or a relay is tripped and all machines will then change colors simultaneously in 1.22 seconds. Timed saved in this case: — example, a 12 head embroidery machine — time required to change color 30 to 60 seconds. In 30 seconds — 12 × 30 seconds = 6 minutes, 6 minutes × number of colors, 4 = that makes 24 minutes of changer over time. This invention will change 4 colors in 7.32 seconds.

This invention can also be used on machines that use double needle bars or holder. Instead of transferring one needle, we can move two or more needles into position.

This automatic changer principle can be incorporated into the original manufacturing of a sewing machine so that it becomes an integral part of the machine. It will be clear that needle positioners and thread trimmers will be incorporated as necessary.

The present invention is made from typical steel or other metals, although plastic can be substituted in whole or in part by casting, molding and other techniques.

Without further elaboration the foregoing will so fully illustrate my invention that others may, by applying current or future knowledge, readily adapt the same for use under various conditions of service.

What is claimed as the invention is:

1. An automatic thread changer for use in connection with a continuous stitching sewing machine having a non-rotating, non-translatory vertically reciprocating needle bar assembly which includes a needle bar, said automatic thread changer comprising a plurality of threaded needles each extending from a needle holder, means for detachably securing said needle bar with any one of said needle holders, and means to move said needle holders one by one sequentially into positive attachment but detachable connection with said needle bar assembly to form a temporary but solid needle bar assembly comprising said needle bar, one of said needle holders and its associated needle, for use in continuous stitching with a selected first one of said needle holders and needles whereby said first needle holder may be detached from said needle bar assembly and a second needle holder brought into operative but detachable connection with said needle bar assembly for use in continuous stitching.

2. The invention of claim 1 wherein said needle holders are actuated by pivot blocks to swing needles not in use away from said needle bar assembly, said needle holders having means for allowing connection and disconnection with said needle bar assembly.

3. The invention of claim 2 wherein said needle bar assembly includes a notch and said needle holder possesses a detent for engagement in said notch.

4. The invention of claim 3 wherein said pivot blocks are actuated by a movable carriage which is driven by a stepping motor means.

5. The invention of claim 4 wherein said carriage travels intermittently on stationary guide rails extending from a mounting plate that is secured to said sewing machine.

6. The invention of claim 5 including cam means, said pivot blocks being caused to travel on said cams means for successive operative connection with said needle bar assembly.

7. The invention of claim 6 wherein the pivot blocks are pivotally secured to a trunion block to avoid flopping.

8. The invention of claim 7 including a thread release and guide means associated with each threaded sewing needle, said thread release and guide means allowing movement of the thread when the particular threaded needle is operatively secured to the needle bar assembly.

9. The invention of claim 1 wherein said automatic thread changer is an integral part of said sewing machine.

10. The invention of claim 1 wherein each of said needle holders are detachably secured, one by one to a slidable connector.

* * * * *